US006199208B1

(12) United States Patent
Torbett

(10) Patent No.: US 6,199,208 B1
(45) Date of Patent: Mar. 13, 2001

(54) ATHLETIC WRIST SUPPORT

(76) Inventor: Shawn Torbett, 109 Bryars Ct., Lexington, SC (US) 29072

( * ) Notice: Subject to any disclaimer, the term of this patent is extended or adjusted under 35 U.S.C. 154(b) by 0 days.

(21) Appl. No.: 09/504,372

(22) Filed: Feb. 15, 2000

(51) Int. Cl.[7] ..... A41D 13/08

(52) U.S. Cl. ..... 2/16; 2/16; 2/162; 2/170; 602/21

(58) Field of Search ..... 2/16, 20, 455, 2/22, 44, 159, 162, 170, 311; 128/878, 879; 602/20, 21, 62, 19

(56) References Cited

U.S. PATENT DOCUMENTS

| | | | | |
|---|---|---|---|---|
| 3,533,106 | * | 10/1970 | Kremp | 2/22 |
| 3,815,908 | * | 6/1974 | Hashimoto | 273/54 B |
| 4,138,108 | * | 2/1979 | Robinson | 273/54 B |
| 4,441,490 | * | 4/1984 | Nirschi | 128/77 |
| 5,307,521 | * | 5/1994 | Davis | 2/22 |
| 5,313,667 | * | 5/1994 | Levine | 2/16 |
| 5,368,550 | * | 11/1994 | Sisley | 602/21 |
| 5,537,692 | * | 7/1996 | Dorr | 2/161.1 |
| 5,611,084 | * | 3/1997 | Garry et al. | 2/93 |
| 5,647,062 | * | 7/1997 | Nigbur | 2/16 |
| 5,652,955 | * | 8/1997 | Skewis | 2/20 |
| 5,873,130 | * | 2/1999 | Lafferty | 2/16 |
| 5,987,641 | * | 11/1999 | Walker | 2/16 |

* cited by examiner

*Primary Examiner*—Gloria M. Hale
*Assistant Examiner*—Tejash Patel

(74) *Attorney, Agent, or Firm*—Michael A Mann; Nexsen Pruet Jacobs & Pollard LLP

(57) ABSTRACT

An athletic wrist support for teaching proper throwing techniques includes an inner body member, preferably made from a soft, flexible material such as Neoprene, which has hook and loop fastening straps to secure the wrist support to the arm. A substantially rigid plate member is attached on an outer portion of the inner body member in such a way that it fits on the upper forearm of a wearer and extends from just below the knuckles on the back of the hand down below the wrist, to prevent pronation motion of the wrist. In a preferred embodiment, the plate member is made from a strong, lightweight plastic, which is substantially rigid, but which will bend under extreme pressure. An outer body member, also preferably made from Neoprene, is attached to an upper portion of the plate member. The outer body member also has hook and loop fasteners that are used to secure the outer body member about the plate member and the inner body member. The wrist support prevents pronation of the wrist, without otherwise disturbing the throwing motion of the hand and arm, causing the object to be thrown at a higher velocity with more consistent accuracy. By preventing pronation of the wrist, the wrist support provides a more consistent release point of the ball, places the wrist in the proper throwing position, decreases stress on the arm and elbow, and causes the person to use more of his or her body instead of their arm to throw the ball. All of these factors contribute to provide more efficient body mechanics, which helps to conserve energy and prevent injury during competition. In essence, by preventing pronation of the wrist, the wrist support forces the wearer to use proper body mechanics, which translates into proper throwing techniques.

8 Claims, 4 Drawing Sheets

ATHLETIC WRIST SUPPORT

BACKGROUND OF THE INVENTION

1. Field of the Invention

The invention described and claimed herein relates generally to athletic wrist supports. More specifically, the present invention includes an athletic wrist support that is placed onto the wrist of a wearer, and prevents the wearer from bending the wrist in a backward direction. Heretofore, athletic wrist supports have been developed which are used for protection against hyperextension of the wrist, for sports such as skating, snowboarding or rollerblading. Other types of athletic wrist supports have a strap or other attachment means that are secured to the thumb, or between the thumb and forefinger. Neither of these types of athletic wrist supports are acceptable for teaching proper throwing technique, because the construction of these previously developed wrist supports interferes with the proper throwing motion of the hand or arm.

The present athletic wrist support is attached to the arm below the wrist without using any brace that encircles the thumb, to prevent unnecessary interference between the wrist support and the throwing motion of the hand or arm. When throwing an object such as a baseball or a football, the wrist of the throwing hand should not be bent in a backward or pronated direction. Therefore, a wrist support that prevents pronation of the wrist, without otherwise disturbing the throwing motion of the hand and arm, causes the object to be thrown at a higher velocity with more consistent accuracy. By preventing pronation of the wrist, the wrist support provides a more consistent release point of the ball, places the wrist in the proper throwing position, decreases stress on the arm and elbow, and causes the person to use more of his or her body instead of their arm to throw the ball. All of these factors contribute to provide more efficient body mechanics, which helps to conserve energy and prevent injury during competition. In essence, by preventing pronation of the wrist, the wrist support forces the wearer to use proper body mechanics, which translates into proper throwing techniques.

The present athletic wrist support includes an inner body member, preferably made from a soft, flexible material such as Neoprene, which has hook and loop fastening straps to secure the wrist support to the arm. A substantially rigid plate member is attached on an outer portion of the inner body member in such a way that it fits on the upper forearm of a wearer and extends from just below the knuckles on the back of the hand down below the wrist, to prevent pronation motion of the wrist. In a preferred embodiment, the plate member is made from a strong, lightweight plastic, which is substantially rigid, but which will bend under extreme pressure. An outer body member, also preferably made from Neoprene, is attached to an upper portion of the plate member. The outer body member also has hook and loop fasteners that are used to secure the outer body member about the plate member and the inner body member.

2. Discussion of the Prior Art

U.S. Pat. No. 3,815,908, issued to Hashimoto, teaches a bowler's wrist support preventing the wrist from bending outwardly when the bowler releases the ball comprising a thumb band portion, a rigid portion and a wrist band portion. The rigid portion has a core comprising an outer rigid member and an inner resilient member. Fastening members are placed so that the support is well positioned over the wrist and the hand irrespective of the size of the hand or thumb while the band portion leaves the palm of the hand free from encumbrances.

U.S. Pat. No. 3,970,305, issued to Hawkins, shows an athletic wrist support for attachment to the arm and hand of a player. While in play, the user may adjust the support to a restricting position to restrict movement of the hand and hence flexure of the wrist in the backward direction, but to allow movement of the hand in the other three planes. When not playing, the user may adjust the support to a neutral position to allow movement of the hand in all four planes. The wrist support comprises an arm plate and a hand plate pivotally coupled together and adapted to be secured to the top of the arm and hand respectively. The two plates are pivotally coupled together for movement about two different axes to allow movement of the hand plate and hence the hand in all four planes. A stop is slidably coupled to the top of the arm plate and which may be slid to a restricting position above the hand plate for restricting motion of the hand plate and hence the hand in the backward direction.

U.S. Pat. No. 4,138,108, issued to Robinson, discloses a hand/wrist positioner or brace adapted for use by persons participating sports, particularly bowling. It is made of flexible material to wrap around the hand and wrist in the manner of a wristband or more specifically a fingerless glove with securing means to hold it in position. It has a thumb hole to receive the thumb and ball of the thumb, its forward end extending to cover the palm and back of the hand. Provided in the front of the article, that is, on the palm side, there is a stiffening member to bridge between the palm and inner side of the wrist contoured to conform and extending into the palm of the hand. This stiffening member prevents forward flexing of the wrist. A second rigid stiffening member is provided in the back of the article to bridge between the back of the hand and wrist, this member having an outwardly bowed contour at the back of the wrist to restrain backward flexing of the wrist beyond the contoured position.

U.S. Pat. No. 5,652,955, issued to Skewis, shows a hand and wrist protector for skaters, having two rigid formed plates which are securely strapped to the wrist with wide hook and loop straps. A first plate extends from the wrist down to a palm position with a concave inner surface and a hard abrasion resistant outer surface. A second plate extends from the wrist down to a dorsal hand position with a convex inner surface which prevents hyperextension of the wrist joint. The inner surfaces are covered with a resilient moisture absorbing surface. The palm position and dorsal hand portions are free of attachment at their anterior and lateral edges so that the thumb and fingers are unrestrained and perspiration is more readily evaporated.

None of the prior art, however, teaches an athletic wrist support having an outer body member and an inner body member, each having separate attachment means for attaching the support to the wrist, and having a substantially rigid plate member therebetween. Further, none of the prior art discloses an athletic wrist support that attaches to the arm of a user without using means for engaging the thumb of a user in any way, together with the previously mentioned features.

SUMMARY OF THE INVENTION

Accordingly, it is an important object of the present invention to provide an athletic wrist support that prevents pronation, or backward bending, of the wearer's wrist, while allowing a free range of normal motion in all other planes.

It is another important object of the present invention to provide an athletic wrist support that has an inner body member and an outer body member, each having separate attachment means for attachment to an arm, and wherein a substantially rigid plate member is positioned therebetween for support.

Yet another important object of the present invention to provide an athletic wrist support that attaches to an arm without attaching in any way to the hand or thumb, so that a natural throwing motion of the arm and hand is facilitated, and is in no way disturbed or interrupted.

Another important object of the present invention to provide an athletic wrist support wherein the substantially rigid plate member is removable and replaceable. Different plate members having varying degrees of rigidity may be interchanged within the wrist support as desired.

Still another important object of the present invention to provide an athletic wrist support that may be placed in a conventional clothes washing machine, either as a complete unit, or after the removal of the substantially rigid plate member.

Another important object of the present invention is to provide an athletic wrist support that is easy and inexpensive to manufacture, and which overcomes some of the problems associated with other types of wrist supports. These and other objects of the present invention will become apparent with a reading of the following specification, the drawings, and the appended claims.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF THE PREFERRED EMBODIMENT

Figure 1:
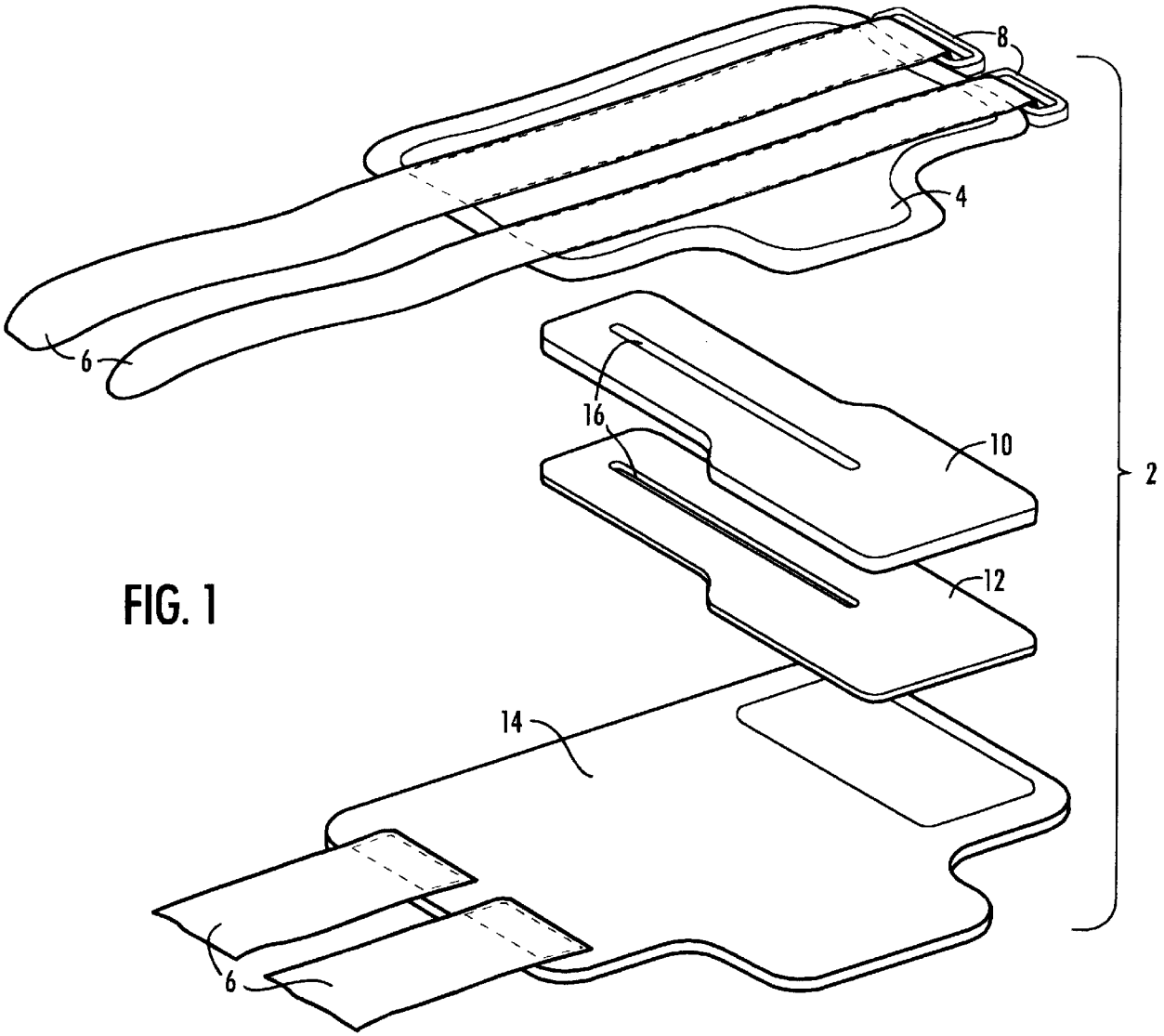
FIG. 1 is an exploded view of the athletic wrist support, showing the inner body member with hook and loop fasteners, a double layer plate member, and an outer body member having hook and loop fasteners with a buckle attachment.
Figure 2:
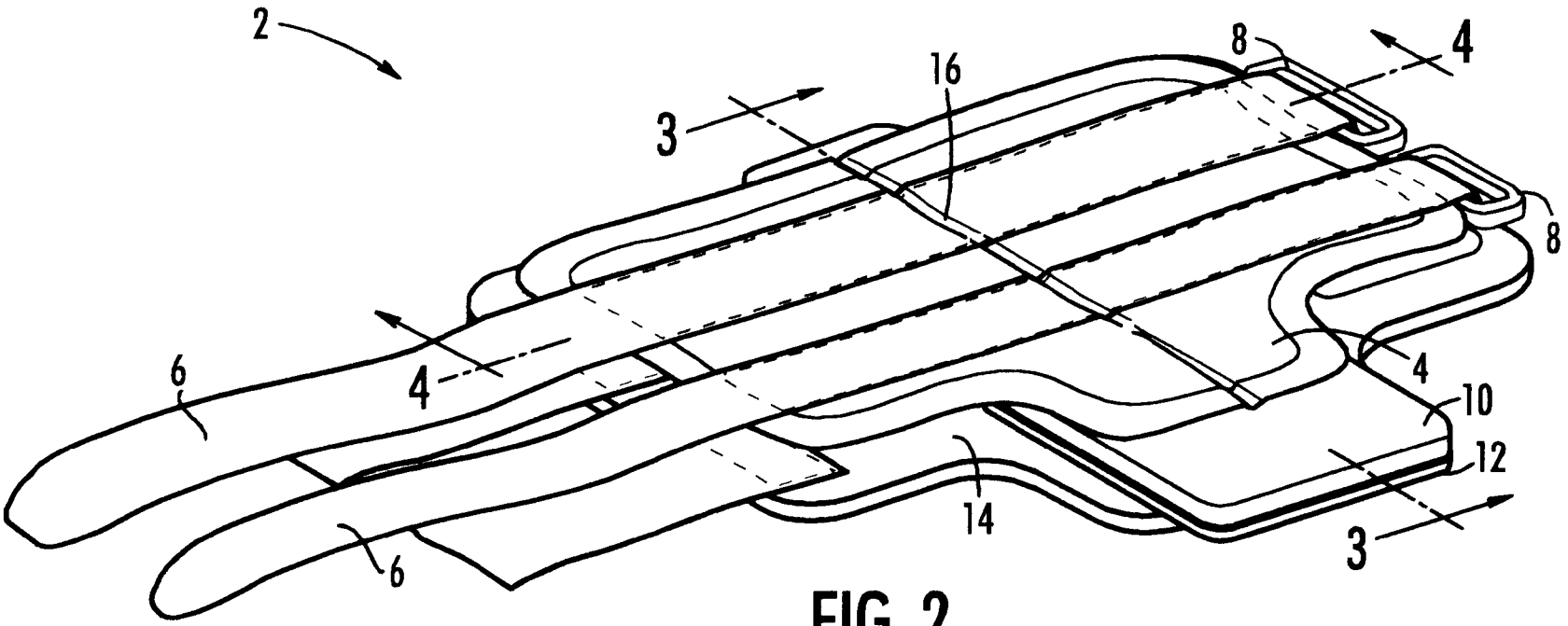
FIG. 2 is a perspective view of the athletic wrist support in an assembled condition.

FIG. 1 illustrates an exploded view of an athletic wrist support 2, showing an outer body member 4 having hook and loop fasteners 6 which pass through the buckle members 8 for securement. A substantially rigid plate member 10 is shown beneath the outer body member, together with a flexible padded plate member 12. An inner body member 14 is shown beneath the flexible padded member 12. These components are fixed together to form an athletic wrist support, wherein the inner body member is first secured to a wearer's arm, using the hook and loop fasteners 6 that are provided. The substantially rigid plate member 10 and the flexible padded plate member 12 (collectively referred to as the "plate member") are secured to an outer portion of the inner body member 14. The outer body member is attached to an outer portion of the plate member, and is secured about the plate member and the inner body member using the hook and loop fasteners threaded through the buckle member. Although the means for securing the inner and outer body members to a wearer's arm are described as hook and loop fasteners, it is to be understood that any suitable attachment means may be utilized for that purpose, such as snaps, adhesive strips, zippers, and the like. FIG. 2 illustrates the assembled components.

Figure 3:
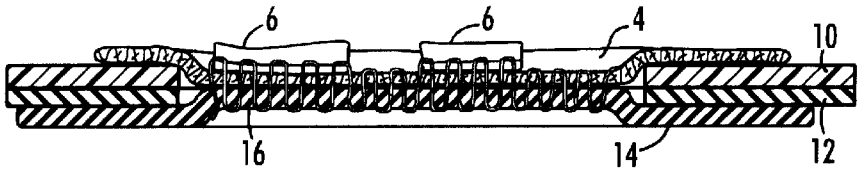
FIG. 3 is a cross-sectional view along the line 3—3 in FIG. 2.

FIG. 3 shows a side cross-sectional view along the lines 3—3 of FIG. 2. The plate member is shown sandwiched between the outer body member and the inner body member. The outer body member and the inner body member, in a preferred embodiment, are both made from a flexible, padded material, such as Neoprene. The substantially rigid plate member 10 is preferably made from a high strength, lightweight plastic, and the flexible padded plate member 12 is made from Neoprene, in a preferred embodiment. It is to be understood, however, that these components may be made from other suitable materials.

Figure 4A:
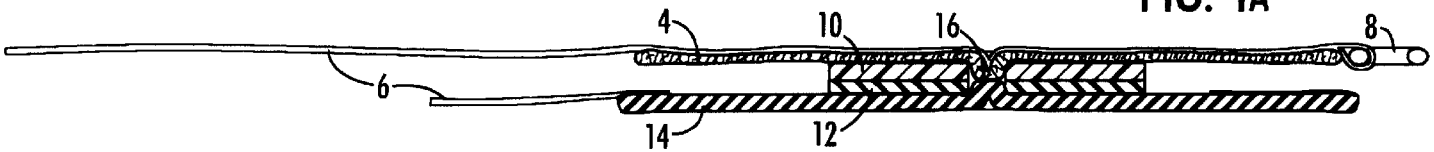
FIG. 4A is a cross-sectional view along the line 4—4 in FIG. 2.

FIG. 4A shows a cross sectional view along the lines 4—4 of FIG. 2. The plate member includes a slit 16 running along a centrally positioned longitudinal axis thereof. The outer body member and the inner body member each protrude approximately halfway through the slit and are sewn together through the slit. In an alternate embodiment, the inner body member and outer body member are removably attached through a slit or hole in the plate member, allowing the plate member to be removed therefrom. Snaps, zippers, or other attachment means may be used to removably attach the inner and outer body members through the hole or slit defined in the plate member.

Figure 4B:
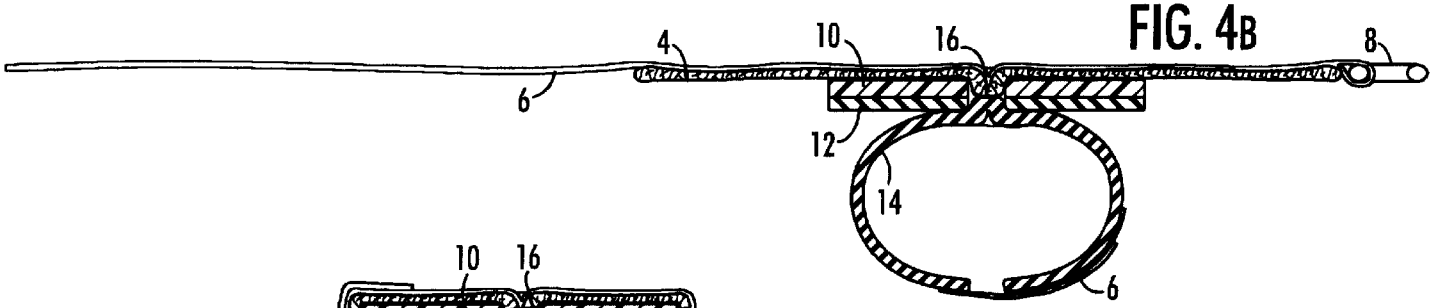
FIG. 4B is a cross-sectional view along the line 4—4 in FIG. 2 showing the inner body member attached using the hook and loop fasteners, and showing the outer body member being free and unattached.
Figure 4C:
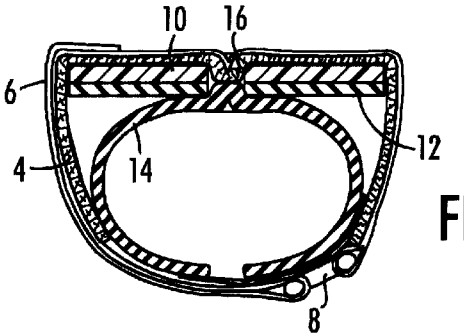
FIG. 4C is a cross-sectional view along the line 4—4 in FIG. 2 showing the inner body member attached using the hook and loop fasteners, and showing the outer body member secured about the inner body member and the plate member.

FIG. 4B shows a cross-sectional view of the athletic wrist support along the lines 4—4 of FIG. 2, wherein the inner body member is in the secured position. The outer body member is in the unsecured, free position. When a wearer is ready to secure the wrist support to an arm, he or she must first secure the inner body member to the arm using the attachment means, as shown in FIG. 4B. After the inner body member is secured, a wearer must then secure the outer body member about the inner body member and the plate member, as shown in FIG. 4C. To secure the outer body member, the hook and loop fastening straps are fed through the buckle member, and then fastened back onto themselves, as shown.

Figure 5:
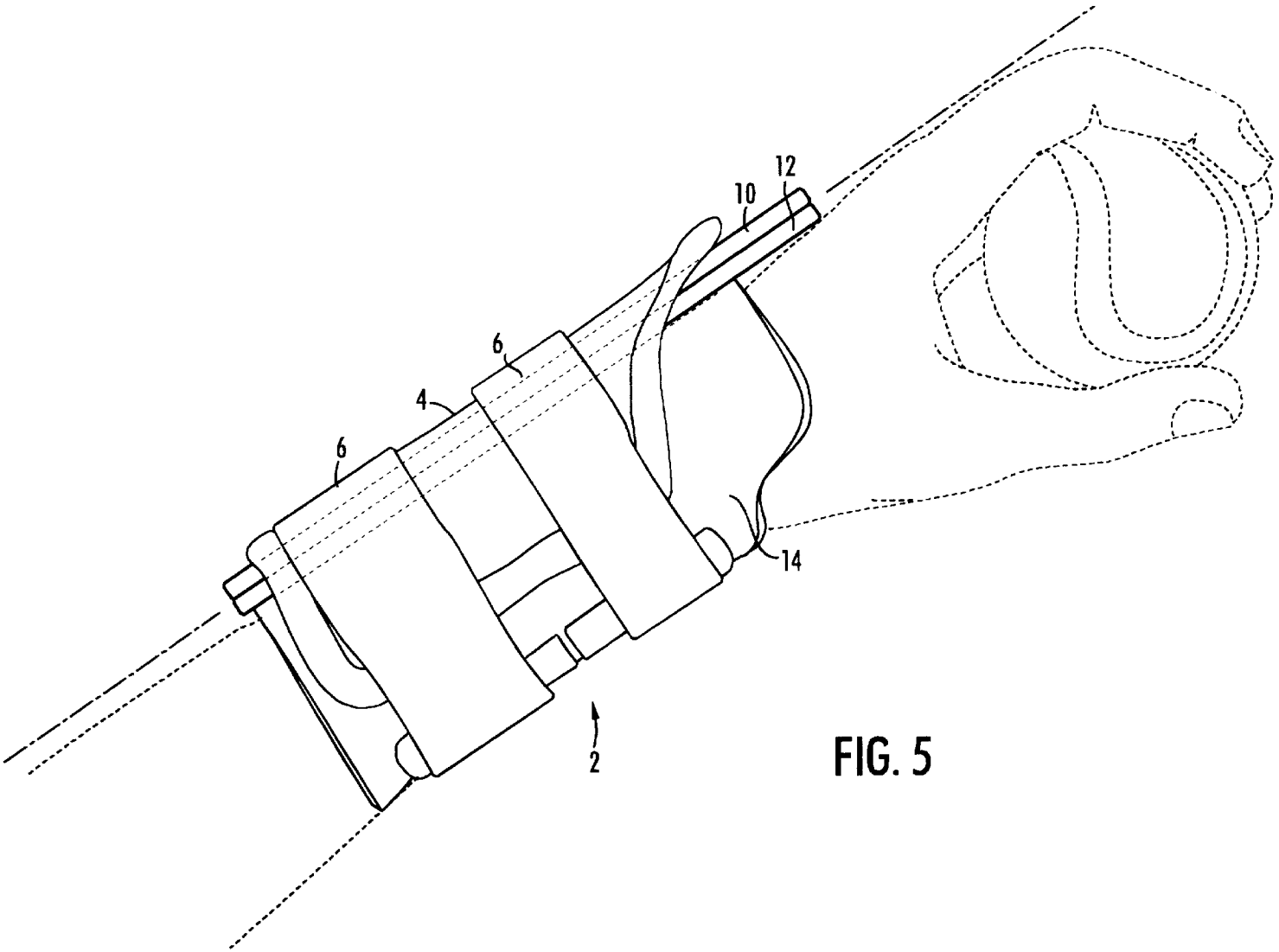
FIG. 5 is a perspective view of the athletic wrist support shown in use on the wrist of a person.

FIG. 5 illustrates the athletic wrist support in use for throwing a baseball. One benefit of having an inner body member and an outer body member, each having separate attachment means, is that if the outer straps become loose or released during competition, the wrist support will remain in place. Also, by having the plate member sandwiched between the two softer body members, the wrist support is comfortable to a wearer, and is less likely to cause injury to an opposing player in the event of a collision during competition.

While a preferred embodiment of the invention has been described using specific terms, such description is for illustrative purposes only, and it is to be understood that changes and variations may be made without departing from the spirit or scope of the following claims.

What is claimed is:

1. An athletic wrist support that prevents a wearer's wrist from bending in a backward direction while throwing an object, and thereby helps a wearer develop proper throwing techniques, said athletic wrist support comprising:

an inner body member formed from a flexible padded material adapted to engage a wearer's wrist, said inner body member also including adjustable securing means for removably securing said inner body member to a wrist of a wearer without encircling a wearer's thumb;

a substantially rigid plate member having a top side and a bottom side, wherein said bottom side is attached to an outer portion of said inner body member, said rigid plate member dimensioned to extend from just below a bottom edge of the knuckles of a throwing hand of said wearer to just below said wrist of said wearer, said rigid plate member being sufficiently rigid to prevent pronation of said wearer's wrist when said wearer throws an object; and an outer body member attached to a top side of said plate member, said outer body member having adjustable attachment means for tightly securing said outer body member about said inner body member and said plate member.

2. The athletic wrist support set forth in claim 1, wherein said securing means on said inner body member includes hook and loop fasteners.

3. The athletic wrist support set forth in claim 1, wherein said attachment means on said outer body member includes hook and loop fasteners.

4. The athletic wrist support set forth in claim 1, wherein said inner body member is made from neoprene.

5. The athletic wrist support set forth in claim 1, wherein said outer body member is made from neoprene.

6. The athletic wrist support set forth in claim 1, wherein said plate member is made from a high impact, lightweight plastic.

7. The athletic wrist support set forth in claim 1, wherein said plate member is formed from two layers secured together, including a substantially rigid upper layer, and a padded lower layer.

8. The athletic wrist support set forth in claim 1, wherein said plate member is removably attached to said inner body member and said outer body member.

* * * * *